US008863406B2

(12) United States Patent
Moore

(10) Patent No.: US 8,863,406 B2
(45) Date of Patent: Oct. 21, 2014

(54) TWO-PIECE TRANSFORMABLE BOOT

(76) Inventor: Linda Faye Moore, Henderson, NV (US)

( * ) Notice: Subject to any disclaimer, the term of this patent is extended or adjusted under 35 U.S.C. 154(b) by 642 days.

(21) Appl. No.: 13/215,310

(22) Filed: Aug. 23, 2011

(65) Prior Publication Data

US 2012/0047766 A1 Mar. 1, 2012

Related U.S. Application Data

(60) Provisional application No. 61/377,283, filed on Aug. 26, 2010, provisional application No. 61/454,554, filed on Mar. 20, 2011.

(51) Int. Cl.

| | |
|---|---|
| ***A43B 3/24*** | (2006.01) |
| ***A43B 3/02*** | (2006.01) |
| ***A43B 23/02*** | (2006.01) |
| ***A43B 23/24*** | (2006.01) |

(52) U.S. Cl.

CPC ..... *A43B 23/0245* (2013.01); *A43B 23/24* (2013.01); *A43B 3/242* (2013.01); *A43B 3/02* (2013.01)

USPC ..... 36/1.5; 36/101

(58) Field of Classification Search

CPC ..... A43B 3/02; A43B 3/24; A43B 3/242; A43B 3/244; A41D 17/00

USPC ..... 36/1.5, 101, 100, 2 R

See application file for complete search history.

(56) References Cited

U.S. PATENT DOCUMENTS

| | | | | | |
|---|---|---|---|---|---|
| 527,717 | A | * | 10/1894 | Pendergast | 36/9 R |
| 815,194 | A | * | 3/1906 | Metz | 36/1.5 |
| 1,090,223 | A | * | 3/1914 | McNeer | 36/1.5 |
| 1,248,239 | A | | 11/1917 | Adams | |
| 1,736,013 | A | * | 11/1929 | Peachey | 36/1.5 |
| 2,155,599 | A | * | 4/1939 | Hutchison | 36/45 |
| 2,230,291 | A | * | 2/1941 | Evans | 36/7.3 |
| 2,306,306 | A | * | 12/1942 | Ferrettie | 36/4 |
| 2,729,899 | A | | 1/1956 | Haase | |

(Continued)

FOREIGN PATENT DOCUMENTS

| | | |
|---|---|---|
| JP | 3145543 U9 | 9/2008 |
| JP | 3147817 U9 | 12/2008 |

(Continued)

OTHER PUBLICATIONS

International Search Report dated Apr. 10, 2012 from corresponding International Patent Application No. PCT/US2011/048719, 5 pages.

*Primary Examiner* — Ted Kavanaugh

(57) ABSTRACT

A two-piece convertible boot. The boot may include a shoe portion for enclosing a wearer's foot and extending substantially up to the wearer's ankle, the shoe portion comprising a sole, an insole, a heel and an upper. The shoe portion can further include an opening for inserting the wearer's foot, and a top end extending downward from the opening. The boot may further include a calf portion for enclosing a portion of the wearer's calf, the calf portion having a top opening disposed at a top end of the calf portion, and a bottom opening disposed at the bottom end of the calf portion, wherein the bottom end of the calf portion can overlap the top end of the shoe portion so as to form a friction fit between the bottom end of the calf portion and the top end of the shoe portion.

14 Claims, 9 Drawing Sheets

(56) References Cited

U.S. PATENT DOCUMENTS

| | | | | | |
|---|---|---|---|---|---|
| 2,824,390 | A | * | 2/1958 | Walker | 36/1.5 |
| 3,003,261 | A | * | 10/1961 | Graham et al. | 36/2 R |
| 3,087,260 | A | | 4/1963 | Hudon | |
| 3,744,158 | A | | 7/1973 | Walker | |
| 3,991,492 | A | | 11/1976 | Dreyer | |
| 4,064,641 | A | | 12/1977 | Levine | |
| D273,624 | S | | 5/1984 | Finch | |
| 4,586,271 | A | | 5/1986 | Maleyko et al. | |
| 4,693,018 | A | | 9/1987 | Maleyko et al. | |
| 4,745,693 | A | * | 5/1988 | Brown | 36/101 |
| 4,771,553 | A | | 9/1988 | Smithdeal | |
| 4,856,207 | A | | 8/1989 | Datson | |
| 4,896,437 | A | | 1/1990 | Johnson | |
| 4,941,213 | A | * | 7/1990 | Grilliot et al. | 2/312 |
| 4,958,447 | A | | 9/1990 | DuPree | |
| 5,249,375 | A | * | 10/1993 | Tabarly | 36/1.5 |
| 5,501,022 | A | | 3/1996 | Cohn | |
| D373,895 | S | | 9/1996 | Bilyew | |
| D396,740 | S | | 8/1998 | Magliulo | |
| 6,457,260 | B1 | | 10/2002 | Roelofs | |
| 6,477,788 | B1 | | 11/2002 | Chen | |
| 6,532,687 | B2 | | 3/2003 | Towns et al. | |
| 6,647,597 | B2 | | 11/2003 | Reiter | |
| 6,880,270 | B2 | | 4/2005 | Prather | |
| D562,534 | S | | 2/2008 | Der | |
| 7,428,787 | B2 | | 9/2008 | Crowley, II et al. | |
| 7,721,470 | B2 | | 5/2010 | Long | |
| 8,046,935 | B2 | * | 11/2011 | Parisi | 36/2 R |
| 2006/0201034 | A1 | * | 9/2006 | Ambrogio | 36/101 |
| 2009/0151202 | A1 | | 6/2009 | Kramer et al. | |
| 2010/0186259 | A1 | | 7/2010 | Garza | |
| 2011/0056094 | A1 | | 3/2011 | Yanke et al. | |

FOREIGN PATENT DOCUMENTS

| | | | |
|---|---|---|---|
| KR | 20-1997-0026641 | U | 7/1997 |
| KR | 20-0308062 | Y1 | 3/2003 |
| KR | 10-2009-0018701 | | 2/2009 |

* cited by examiner

TWO-PIECE TRANSFORMABLE BOOT

CROSS-REFERENCE TO RELATED APPLICATIONS

This application claims priority to U.S. Provisional Patent Application No. 61/377,283, filed Aug. 26, 2010 and entitled TWO-PIECE TRANSFORMABLE BOOT, and U.S. Provisional Patent Application No. 61/454,554, filed Mar. 20, 2011 and entitled TWO-PIECE TRANSFORMABLE BOOT WITH DUAL MAGNET ATTACHMENT SYSTEM, the entire contents of which are hereby incorporated by reference.

BACKGROUND

Boots are a fashionable and desirable article of apparel, and come in a variety of styles, sizes, and heights. Typically, boots include a foot-enclosing portion, which includes the sole, heel and upper portions of the boot, with the upper portion extending up to the ankle of the wearer. Each of these portions can vary in style; for example, the height of the heel may be negligible, may be several inches, or may be anywhere in between, with the sole and the upper having a curvature that corresponds to the height of the heel. Some boots can also include a calf-enclosing portion, which can extend from the ankle to any point between the ankle and the knee, with some styles even extending past the knee and enclosing a portion of the wearer's thigh. Because each portion of the boot can vary in style, height, length, width, and so forth, a large variety of boots exist on the market.

Such a variety of boot styles can present problems for the typical fashion-conscious individual. For example, individuals who prefer that their clothing and their footwear form a cohesive ensemble may find it difficult—and quite expensive—to obtain a sufficient amount of boots to coordinate with their outfits. A large collection of boots would also require significant storage space at one's home, and would be difficult to transport during travel.

Furthermore, due to physical differences between individuals, such as foot size and calf girth, some may find that a boot that fits well over the foot may not fit well over the calf, and vice-versa. Boots commonly available on the market are typically sold in sizes focusing on the size of the foot, leaving many to wear boots with ill-fitting portions, (for example calf portions having insufficient or excessive girth), that can worsen wearability or can cause discomfort while being worn.

A simple, low-cost and fashionable solution to at least the above issues is therefore desired.

SUMMARY

According to at least one exemplary embodiment, a two-piece convertible boot may be disclosed. The boot may include a shoe portion for enclosing a wearer's foot and extending substantially up to the wearer's ankle, the shoe portion comprising a sole, an insole, a heel and an upper. The shoe portion can further include an opening for inserting the wearer's foot, and a top end extending downward from the opening. The boot may further include a calf portion for enclosing a portion of the wearer's calf, the calf portion having a top opening disposed at a top end of the calf portion, and a bottom opening disposed at the bottom end of the calf portion, wherein the bottom end of the calf portion can overlap the top end of the shoe portion so as to form a friction fit between the bottom end of the calf portion and the top end of the shoe portion.

According to another exemplary embodiment, the two-piece convertible boot can include a shoe portion for enclosing a wearer's foot and extending substantially up to the wearer's ankle, the shoe portion comprising a sole, an insole, a heel and an upper. The shoe portion can further include an opening for inserting the wearer's foot, a top end extending downward from the opening, and a fastener disposed on or proximate the top end. The boot may further include a calf portion for enclosing a portion of the wearer's calf, the calf portion having a top opening disposed at a top end of the calf portion, and a bottom opening disposed at a bottom end of the calf portion, the bottom end of the calf portion extending upward from the bottom opening, wherein the bottom end of the calf portion is adapted to overlap a portion of top end of the shoe portion, and wherein the fastener is not a zipper.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
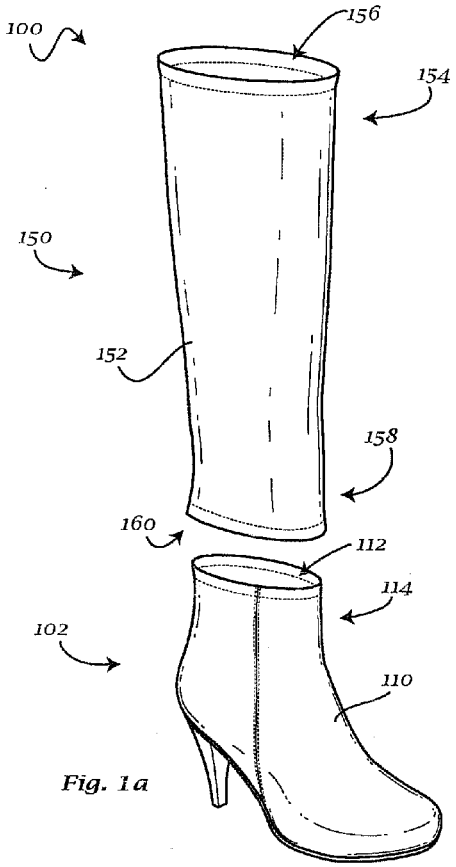
FIGS. 1*a*-1*b* show an exemplary embodiment of a two-piece transformable boot.
Figure 1B:
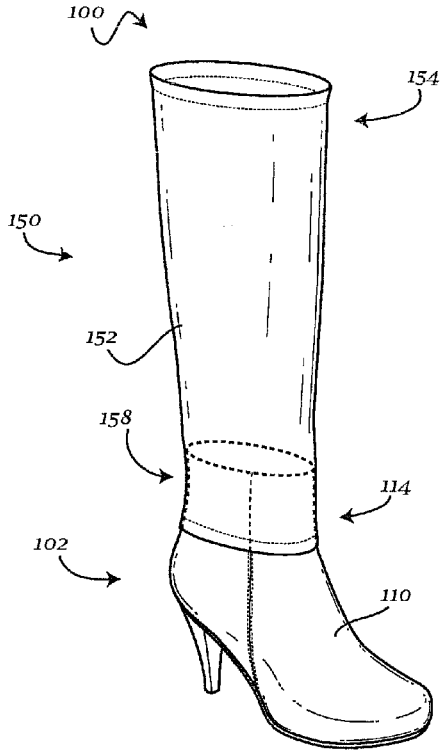

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a two-piece transformable boot may be disclosed. The two-piece transformable boot may include a lower shoe portion enclosing the foot and extending substantially up to the ankle of the wearer, and an upper calf portion enclosing the lower leg and extending substantially from the ankle to the knee of the wearer. The lower end of the upper calf portion may be sized such that it slides over the upper end of the lower shoe portion so as to form a friction fit therebetween; however fasteners for coupling the shoe portion and the calf portion may also be provided.

The outer surfaces of the shoe portion and the calf portion may be constructed from the same material, for example, leather, suede, faux leather, alcantara, or any desired fabric. The outer surfaces of the shoe portion and the leather portion may further have a similar visual appearance, that is, the outer surfaces may have substantially the same texture, coloration, grain, stitching, or any other desired aesthetic features, so as to present the appearance of a single-piece boot to an observer. The inner surfaces of the shoe portion and calf portion may also be constructed from any desired material and may have a visual appearance that is different from the outer surface of the calf portion. The calf portion may further be adapted to be folded, compressed, extended, turned inside out, and otherwise manipulated so as to create a plurality of boot styles. In some embodiments, the calf portion may be manipulated so as to create about thirty-eight diverse boot styles, although other styles may be contemplated and created as desired. Furthermore, the inner surface of the calf portion may have any desired pattern, texture, or decoration.

It should be appreciated that many diverse styles, patterns, textures and other decorations for the inner surface of the calf portion and boot portion may be contemplated and provided as desired. Similarly, many diverse styles of shoe portions may be provided, having, for example, diverse heel heights and styles, platform heights, insoles, outsoles, upper and arch curvatures, and so forth. Both the shoe and calf portions may further be provided in diverse sizes. However, it should also be appreciated that, regardless of size, style, or any other feature, any calf portion and any shoe portion that are provided in accordance with this disclosure may be combined with each other, for example by friction fit coupling, so as to present the appearance of a single-piece boot.

Turning to FIGS. 1*a*-1*e*, a first exemplary embodiment of a two-piece transformable boot 100 may be disclosed. Transformable boot 100 may include a lower shoe portion 102 and an upper calf portion 150. Lower shoe portion 102 may include a sole 104, an insole 106, a heel 108, and an upper 110, each of which may be constructed from any desired material and from any desired number of components.

In the interior of shoe portion 102, for any particular size of shoe portion 102, the distance between sole 104 and upper 110 may be greater than the distance commonly used in the art for a shoe or boot of a corresponding size. The extra distance may be provided to accommodate insole 106, which may have an increased thickness and may include one or more layers of padding. For example, insole 106 may include two layers of padding, each of which can be formed a resilient, cushioning material, for example, but not limited to yarn, cotton, gel, carpet material, and so forth. Insole 106 may further include a backing to reduce the likelihood of slippage of insole 106 within shoe portion 102. Such backing may be formed from, for example but not limited to, latex or any other anti-slipping material. Insole 106 may be removable and replaceable, and such insoles may be provided separately so as to give the wearer a choice of interchangeable insoles for use with boot 100. The extra distance between sole 104 and upper 110 may further allow the wearer to use insoles having increased thicknesses without having to obtain a greater size of shoe portion 102.

Figure 1C:
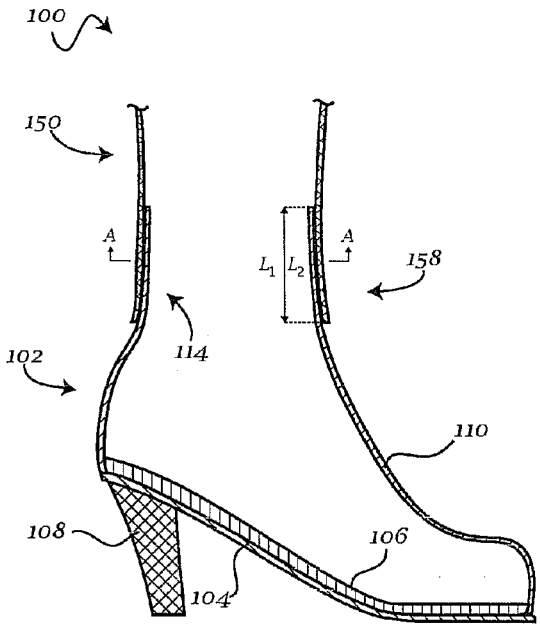
FIG. 1*c* is a vertical and longitudinal cross-section of an exemplary embodiment of a two-piece transformable boot.
Figure 1D:
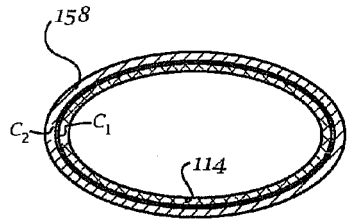
FIG. 1*d* is a horizontal cross section of an exemplary embodiment of a two-piece transformable boot along line A-A of FIG. 1*c*.

Upper 110 may surround the foot of the wearer and may extend from sole 104 towards an opening 112 through which the foot of the wearer may be inserted. Adjacent to and extending below opening 112 may be a top end 114 which may be substantially cylindrical. As shown in FIGS. 1*c*-1*d*, top end 114 may have an outer circumference $C_1$ along a length $L_1$. Outer circumference $C_1$ may be substantially constant along length $L_1$, or may vary slightly due to flaring of top end 114.

It should be appreciated that the shoe portion 102 illustrated in the Figures is merely exemplary; shoe portion 102 may be provided in any known shoe size (for example, but not limited to, US women's sizes 2-16) and in any known shoe style, and may further be custom-fitted to a particular wearer's foot.

Calf portion 150 can include a substantially tubular body 152, a top end 154 having a top opening 156, and a bottom end 158 having a bottom opening 160. Calf portion 150 may be sized such that, when worn, the calf portion can extend from substantially above or below the knee of the wearer to substantially proximate the ankle of the wearer, with bottom end 158 of calf portion 150 overlapping the top end 114 of shoe portion 102. As shown in FIGS. 1*c*-1*d*, bottom end 158 may be substantially cylindrical and may have an inner circumference $C_2$ along a length $L_2$. Inner circumference $C_2$ may be substantially constant along length $L_2$, or may vary slightly due to flaring of bottom end 114. It should be appreciated that the calf portion 150 illustrated in the Figures is merely exemplary; calf portion 150 may be provided for any desired calf size (for example, but not limited to S, M, L and XL) and in any style, and may further be custom-fitted to a particular wearer's calf.

Figure 1E:
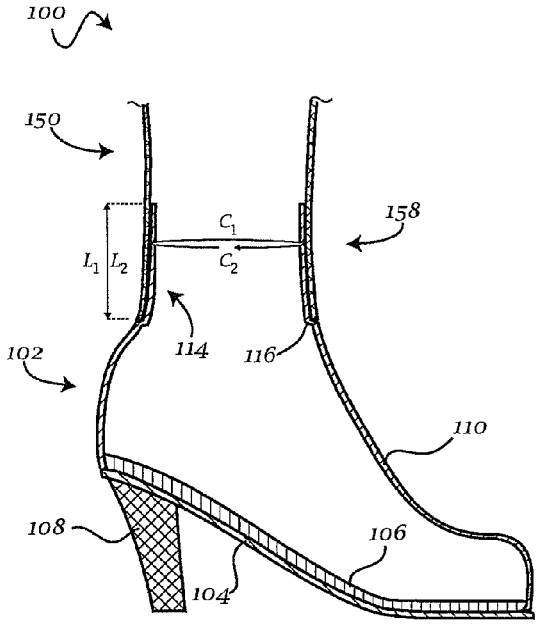
FIG. 1*e* is a vertical and longitudinal cross-section of another exemplary embodiment of a two-piece transformable boot.

Inner circumference $C_2$ of the bottom end 158 of calf portion 150 may be substantially similar to, or slightly greater than, outer circumference $C_1$ of the top end 114 of shoe portion 102 at any point along the lengths $L_1$, $L_2$ of ends 114, 158, respectively, regardless of whether top end 114 and bottom end 158 are flared or have constant circumferences along their lengths. Consequently, when calf portion 150 is disposed over shoe portion 102, a friction fit may exist between top end 114 of shoe portion 102 and bottom end 158 of calf portion 160. This can allow calf portion 150 to be maintained in place over shoe portion 102 without separating therefrom, obviating the use of fasteners such as zippers to prevent separation of the two pieces. Furthermore, such an arrangement allows boot 100 to have an appearance of a single-piece boot without the need for concealment of fasteners such as zippers nor any additional members or portions of the boot adapted to conceal such fasteners. In some embodiments, as shown in FIG. 1*e*, the circumference of top end 114 may be less than the circumference of the adjacent portion of upper 110, thereby defining a rim 116 at the bottom edge of top end 114. The width of rim 116 may be substantially similar to the thickness of the material of calf portion 150 at bottom end 158. This can allow bottom end 158 to fit over top end 114 while creating a flush appearance between the exterior surface of calf portion 150 and the exterior surface of shoe portion 102.

As shoe portion 102 and calf portion 150 may be provided in a variety of styles and sizes, it should be appreciated that the friction fit therebetween can be maintained regardless of the particular style or size of either shoe portion 102 or calf portion 150. Therefore, in one exemplary embodiment of the two-piece transformable boot 100, the outer circumference $C_1$ of top end 114 can be constant for any shoe portion provided in accordance with this disclosure, regardless of the particular style and size of shoe portion 102. Similarly, the inner circumference $C_2$ of bottom end 158 can be constant for any calf portion provided in accordance with this disclosure, regardless of the particular style and size of calf portion 150. In such an embodiment, maintaining circumferences $C_1$ and $C_2$ constant can allow for interchangeability between any shoe portion and any calf portion that are provided in accordance with this disclosure. Exemplary values for circumferences $C_1$ and $C_2$ may be within the range of between about 8 inches and about 14 inches, but are not necessarily limited to that range and may be altered based on any desired considerations, including aesthetic appearance. Furthermore, lengths $L_1$ and $L_2$ may be such that the overlap between the calf portion and the shoe portion is sufficient to prevent, or substantially reduce the likelihood of separation between the two portions while boot 100 is in use. However, lengths $L_1$ and $L_2$, and, consequently, the overlap therebetween, may vary depending on the size and style of the particular shoe portion 102 and calf portion 150 that are used. Exemplary values for lengths $L_1$ and $L_2$, and, consequently, the overlap therebetween, may be within the range of between about 0.5 inch and about 5 inches, but are not necessarily limited to that range and may be altered based on any desired considerations, including aesthetic appearance, functionality, and so forth.

In an alternate exemplary embodiment, the outer circumference $C_1$ of top end 114 of a shoe portion 102 may vary in proportion to the size of the particular shoe portion 102. This may be desired, for example, because of aesthetic considerations, for accommodation of greater ankle widths in connection with larger shoe sizes, or any other consideration. Exemplary correlations between the outer circumference $C_1$ of top end 114 and the size of shoe portion 102 are given in Table 1, but should not be considered limiting, as diverse correlations may be contemplated because of aesthetic, functional, or other considerations.

TABLE 1

Exemplary size-circumference correlations.

| | Shoe Size (US women's) | | | | | | |
|---|---|---|---|---|---|---|---|
| | 5 | 5.5 | 6 | 6.5 | 7 | 7.5 | 8 |
| Outer circumference (inches) | 10 | 10.125 | 10.25 | 10.375 | 10.5 | 10.625 | 10.75 |
| | Shoe Size (US women's) | | | | | | |
| | 8.5 | 9 | 9.5 | 10 | 10.5 | 11 | 12 |
| Outer circumference (inches) | 10.875 | 11 | 11.125 | 11.25 | 11.375 | 11.5 | 11.75 |

For such embodiments, wherein the outer circumference $C_1$ of top end 114 varies, the bottom end 158 of calf portion 150 may be adapted to friction fit with top end 114 of shoe portion 102 in several manners. In one exemplary embodiment, bottom end 158 of calf portion 150 may include an elastic material therein, or may be formed from an elastic material, thereby allowing the inner circumference $C_2$ bottom end 158 to vary such that bottom end 158 may be stretched to fit over top end 114. Furthermore, the elasticity of bottom end 158 may facilitate a friction fit between bottom end 158 and top end 114 for any outer circumference $C_1$ of top end 114. In another exemplary embodiment, diverse calf portions 150 may be provided, such that any calf portion 150 can correspond to a particular size of shoe portion 102, thereby maintaining the substantial equivalence between outer circumference $C_1$ of top end 114 and inner circumference $C_2$ of bottom end 158. Furthermore, in such embodiments, an allowance for a difference between $C_1$ and $C_2$ may be provided; for example, the inner circumference $C_2$ of bottom end 158 of a calf portion 150 may be between about 95% and about 105% of the outer circumference $C_1$ of the top end 114 of corresponding shoe portions 102. This can allow for a calf portion 150 to fit several sizes of shoe portion 102, while providing for the friction fit between top end 114 and bottom end 158 thereof.

It should be appreciated that alternate embodiments of two-piece convertible boot 100 may include diverse structures to enhance the friction fit between boot portion 102 and calf portion 150. Such structures may include, but are not limited to an elastic band disposed between the outer surface and the inner surface of calf portion 150 at bottom end 158, a drawstring, ribbon, lace, or belt-and-buckle disposed around the bottom end 158 of calf portion 150 that can be tightened to enhance the friction fit, and so forth. Such structures may further include fasteners such as snaps, magnet pairs, hook & loop fasteners, button & loop fasteners, button & eyelet fasteners, bar latch, buckles, and so forth, wherein such structures are generally horizontally oriented and disposed at the bottom end 158 of calf portion 150, such that fastening the structure decreases the circumference of bottom end 158. Such structures may further include a vertically oriented zipper disposed at the bottom end 158 of calf portion 150, such that fastening the zipper decreases the circumference of bottom end 158.

Figure 2A:
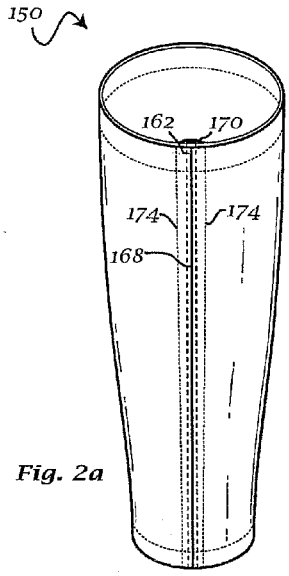
FIG. 2*a* shows an exemplary embodiment of a calf portion for a two-piece transformable boot.
Figure 2B:
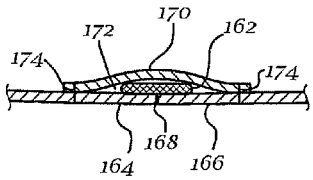
FIGS. 2*b*-2*d* are partial horizontal cross-sections of an exemplary embodiment of a calf portion for a two-piece transformable boot.
Figure 2C:
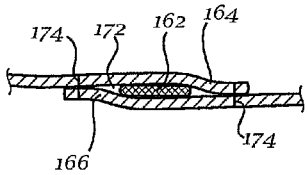

Turning to FIGS. 2*a*-2*f*, calf portion 150 may include therein plastically deformable structures for changing and maintaining the shape and configuration of calf portion 150. For example, such structures can allow calf portion 150 to be folded, adjusted, molded, cuffed, pushed up or down so as to form folds or creases, turned inside out, or partially inverted and layered over itself, and can further allow calf portion 150 to maintain such shapes and configurations. In one embodiment of calf portion 150, as shown in FIGS. 2*a*-2*d*, a flexible strip 162 may be disposed within calf portion 150. Flexible strip 162 may be constructed from any plastically deformable material that enables boot 100 to function as described herein. Flexible strip 162 may be coupled to calf portion 150 in a variety of manners. For example, as shown in FIGS. 2*a*-2*b*, the edges 164, 166 of a piece of material from which calf portion 150 is constructed may be left unfinished, and may be positioned to abut each other, creating a raw seam 168. An elongated piece of material 170 may then be sewn to the edges such that a channel 172 into which flexible strip 162 may be placed is defined between edges 164, 166 and the piece of material 170. The raw seam 168 can then be hidden by the piece of material 170, and two seams 174 can be created. Horizontal seams may then be sewn at the top and bottom of the channel, enclosing flexible strip 162 therein. Alternatively, as shown in FIG. 2*c*, the edges 164, 166 of a piece of material from which calf portion 150 is constructed may be finished edges, and may overlap so as to create a channel 172 into which flexible strip 162 may be placed. The edges may then be sewn to each other, creating two seams 174. Horizontal seams may then be sewn at the top and bottom of the channel, enclosing flexible strip 162 therein. Additional flexible strips 162 may be provided at desired locations around the circumference of calf portion 150 in the manner described herein.

Figure 2D:
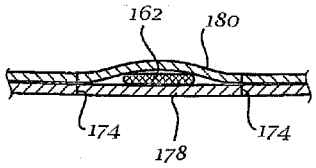

Alternatively, as shown in FIG. 2*d*, flexible strip 162 may be disposed between the material of the outer surface 178 of calf portion 150 and the material of the inner surface 180 of calf portion 150. Flexible strip 162 may then be held in place by any known fasteners, for example by seams 174. Additional flexible strips 162 may be provided at desired locations around the circumference of calf portion 150 in the manner described herein.

Figure 2E:
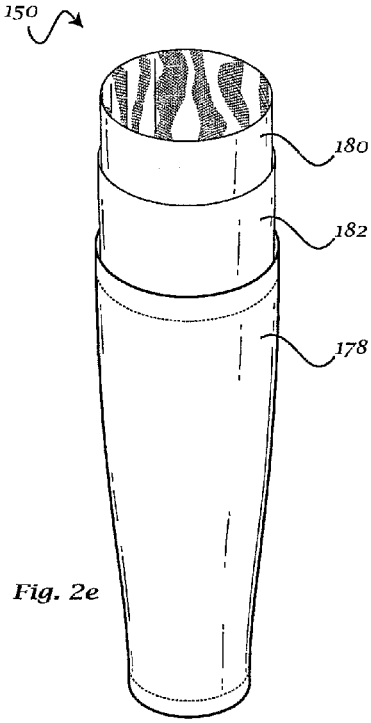
FIG. 2*e* shows another exemplary embodiment of a calf portion for a two-piece transformable boot.
Figure 2F:
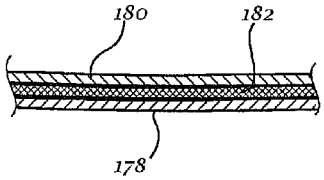
FIG. 2*f* is partial horizontal cross-section of the exemplary embodiment of a calf portion of FIG. 2*e*.
Figure 3A:
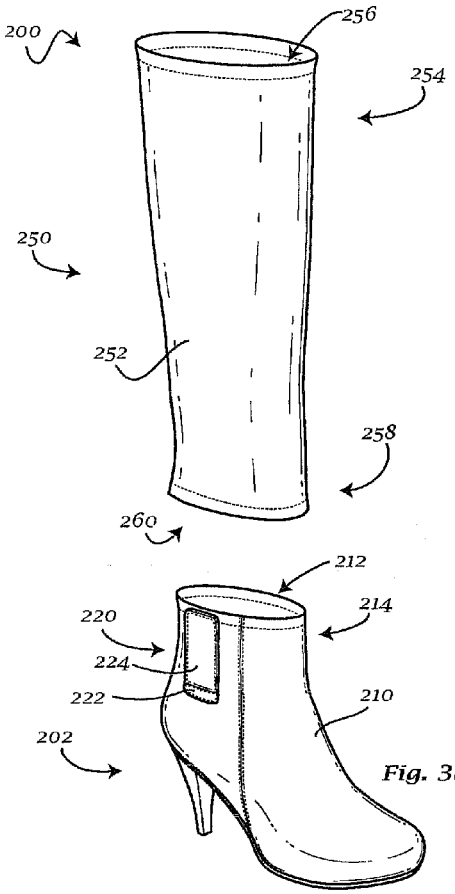
FIGS. 3*a*-3*b* show another exemplary embodiment of a two-piece transformable boot.
Figure 3B:
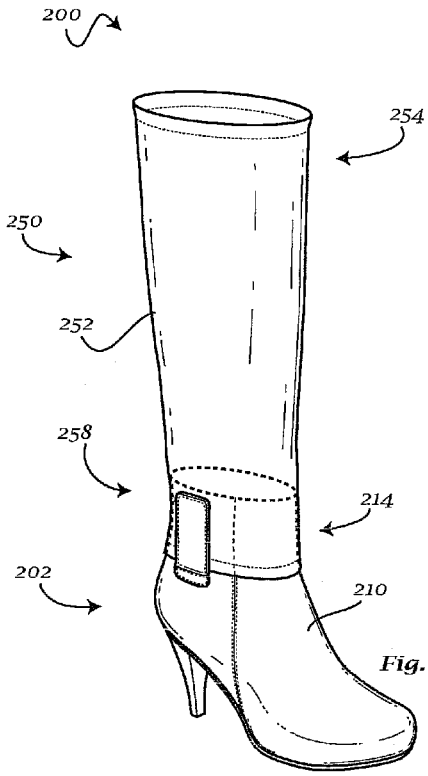
Figure 3C:
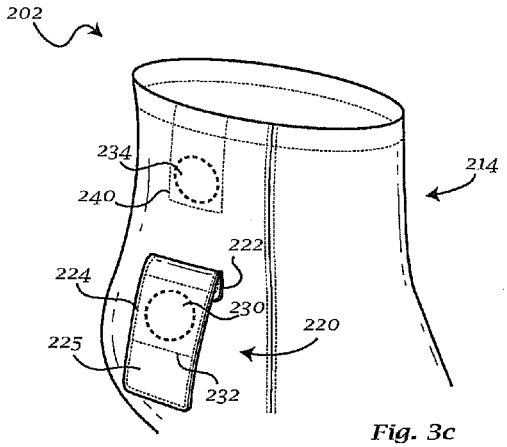
FIG. 3*c* is a detail of the exemplary embodiment of FIGS. 3*a*-3*b*.
Figure 3D:
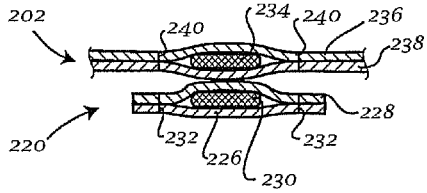
FIG. 3*d* is a partial horizontal cross section of the exemplary embodiment of FIGS. 3*a*-3*b*.

Alternatively, as shown in FIGS. 2*e*-2*f*, a liner 182 may be disposed between the material of the outer surface 178 of calf portion 150 and the material of the inner surface 180 of calf portion 150. Liner 182 may be substantially tubular so as to conform to the shape of calf portion 150, and may be formed from any plastically deformable material that enables boot 100 to function as described herein.

Alternatively, a wire frame may be disposed between the material of the inner surface and the material of the outer surface of the calf portion. The wire frame may consist of a plurality of vertically elongated members extending from the top end to the bottom end of the calf portion, and a plurality of annular members coupled to the vertically elongated members and disposed at diverse heights along the length of the calf portion.

Alternatively, one or both of the outer surface and the inner surface of calf portion 150 may be formed from a plastically deformable material that enables boot 100 to function as described herein. Additionally any known material may be used and treated with appropriate compounds so as to impart plastically deformable characteristics to the material. For example, but not limited to, such materials may include rubber, polyester, foam, netting, leather, other polymeric materials, and so forth, the materials being treated such that plastically deformable characteristics are achieved that enable boot 100 to function as described herein.

Turning to FIGS. 3*a*-3*d*, another embodiment of a two-piece transformable boot 200 may be disclosed. The elements of boot 200 that are substantially similar to elements of boot 100 are identified with similar numbers in the 200 range and should be understood to have substantially similar configurations and functions. It should also be appreciated that all above-disclosed features of the embodiments of two-piece transformable boot 100 are applicable to the embodiments of two-piece transformable boot 200, with the differences between the embodiments being those disclosed below.

The shoe portion 202 of boot 200 may include a flap 220 coupled thereto. Flap 220 may be formed from the same material as the outer surface of shoe portion 202, and may have a substantially similar appearance thereto. Flap 220 may have a fixed portion 222 which can be coupled to shoe portion 202, for example by being sewn to shoe portion 202, and a movable portion 224 which, when in a first position abutting shoe portion 202, can overlap a portion of top end 214 of shoe portion 202. Flap 220 can have an outer surface 226 and an inner surface 228, between which may be disposed a magnet 230, which can be maintained in place by seams 232. A complementary magnet 234 may be disposed between the inner surface 236 and outer surface 238 of the top portion 214 of shoe portion 202, and maintained in place by seams 240. Complementary magnet 234 may be positioned such that, when movable portion 224 of flap 220 abuts shoe portion 202, magnets 230, 234 are proximate each other. Magnets 230, 234 may be oriented such that they attract each other when the magnets are proximate each other. Movable portion 224 of flap 220 can further include a free end 225, which can allow the wearer to pull the flap to a second position away from top end 214 so as to separate the magnets.

When flap 220 is in the second position and the magnets are separated, bottom end 258 of calf portion 250 may be positioned over top end 214 of shoe portion 202. Flap 220 can then be returned to the first position, sandwiching a part of bottom end 258 between flap 220 and top end 114. Flap 220 and associated magnets 230, 234 can thus facilitate maintaining calf portion 250 in place, further facilitating the friction fit existing between the calf portion and the shoe portion. Furthermore, any desired accessories or ornaments may be positioned and maintained in place between flap 220 and shoe portion 202. Flap 220 may also have any desired logos or other indicia disposed on the surface thereof.

It should be appreciated that alternate embodiments of two-piece convertible boot 200 may include diverse fasteners in lieu of, or in addition to, flap 220. For example, such fasteners may include a spring-biased flap, wherein the movable portion of the flap is held in position against boot portion 202 by the force of a spring or similar resilient member. Alternatively, a clip, similar to a money clip, may be provided, wherein the clip has a resilient portion that facilitates maintaining calf portion 250 in place. Alternatively, fasteners may be provided on the outer surface of top end 214 of boot portion 202 that engage complementary fasteners provided on the inner surface of bottom end 258 and top end 254 of calf portion 250. Such fasteners may include snaps, hook-and-loop fasteners, buttons, and so forth. Alternatively, a magnet may be disposed between the inner surface 236 and outer surface 238 of the top portion 214 of shoe portion 202, which can engage one of complementary magnets disposed between the inner surface and the outer surface of calf portion 250, the complementary magnets being positioned at the top end 254 and bottom end 258 of calf portion 250. Alternatively, a fastener disposed on the outer surface of top end 214 of boot portion 202 may engage a complementary fastener disposed on the outer surface of bottom end 258 of calf portion 250. Such fasteners may include belt-and-buckle type fasteners, button-and-loop type fasteners, and so forth. Alternatively, a fastener disposed on the outer surface of the top portion 214 of boot portion 202 can engage, or be inserted through, one of a plurality of apertures or eyelets defined in boot portion 250 and extending from bottom end 258 to top end 254. Such fasteners can include bar-latch type fasteners, buttons, ribbons, ties, laces, and so forth. Additional alternate fasteners may also be contemplated and provided as desired.

As discussed above, for all embodiments of the two-piece convertible boot disclosed herein, calf portion 150/250 may be manipulated into a variety of shapes and configurations, allowing the two-piece transformable boot 100/200 to be worn in a variety of styles. The plastically deformable structures of the calf portion allow calf portion 150/250 to maintain such shapes and configurations while the boot is in use. Exemplary styles for the two-piece transformable boot 100/200 as well as exemplary methods of creating such styles are described in the following paragraphs and shown in the corresponding Figures. It should be appreciated that the described styles are not limiting, and that the described styles may be used at least with any of the embodiments of the two-piece transformable boot disclosed herein. Furthermore, the decorative pattern of the inner material of the calf portion 100/200 that is shown in the Figures is merely exemplary, and any desired decorative pattern or material may be used. While in the following Figures reference is made to the embodiments of transformable boot 100, they should be considered as applicable to the embodiments of transformable boot 200, as well as any other embodiments of the two-piece transformable boot that may be disclosed herein.

Figure 4A:
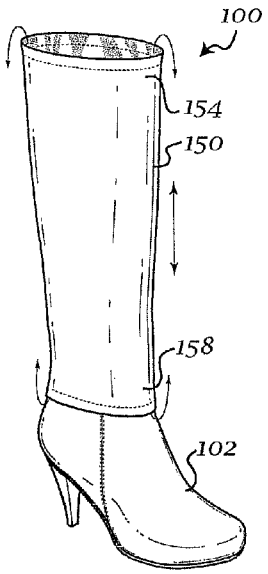
FIGS. 4*a*-4*h* show an exemplary embodiment of a two-piece transformable boot in a knee-high boot configuration.

FIG. 4*a* shows an exemplary embodiment of boot 100 configured in a "knee-high boot" style. Calf portion 150 may be donned first, followed by shoe portion 102. Bottom end 158 of the calf portion 150 can then be slipped over the top end of shoe portion 102. Top end 154 of calf portion 150 can then be pulled up to its highest position without any further manipulation.

Figure 4B:
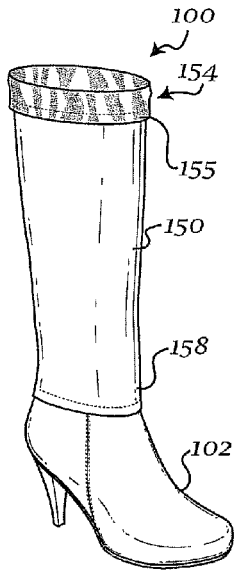

FIG. 4*b* shows an exemplary embodiment of boot 100 configured in a "knee-high boot with a cuff" style. Calf portion 150 may be donned first, followed by shoe portion 102. Bottom end 158 of the calf portion 150 can then be slipped over the top end of shoe portion 102. Top end 154 of calf portion 150 can then be pulled up to its highest position and inverted so as to form a fold, creating an upper cuff 155 which can reveal the inner material of calf portion 150.

Figure 4C:
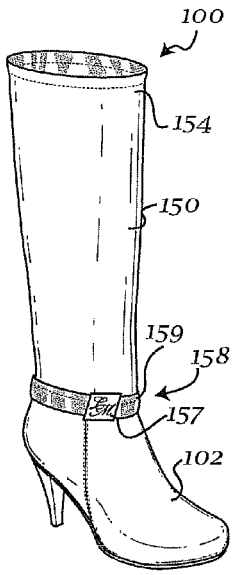

FIG. 4*c* shows an exemplary embodiment of boot 100 configured in a "knee-high boot with ankle strap" style. Calf portion 150 may be donned first, followed by shoe portion 102. Bottom end 158 of the calf portion 150 can then be slipped over the top end of shoe portion 102. Top end 154 of calf portion 150 can then be pulled up to its highest position, while the bottom end 158 of calf portion 150 may be inverted so as to form a fold, creating a lower cuff 159 which can reveal the inner material of calf portion 150, thereby simulating an ankle strap. An ornament 157 may then be attached to the cuff so as to simulate a buckle.

Figure 4D:
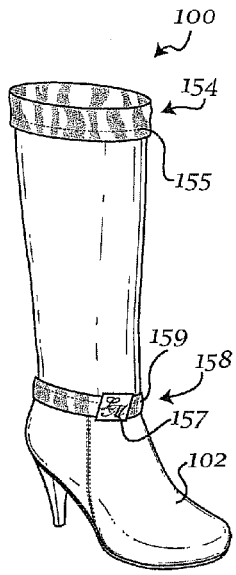

FIG. 4*d* shows an exemplary embodiment of boot 100 configured in a "knee-high boot with cuff and ankle strap" style. Calf portion 150 may be donned first, followed by shoe portion 102. Bottom end 158 of the calf portion 150 can then be slipped over the top end of shoe portion 102. Top end 154 of calf portion 150 can then be pulled up to its highest position, and both top end 154 and bottom end 158 may be inverted so as to form two folds, creating upper and lower cuffs 155, 159, which can reveal the inner material of calf portion 150. An ornament 157 may then be attached to lower cuff 159 so as to simulate a buckle.

Figure 4E:
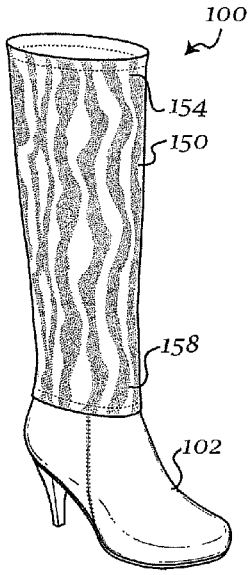

FIG. 4*e* shows an exemplary embodiment of boot 100 configured in a "reversible knee-high boot" style. Calf portion 150 may first be turned inside out and then donned, and shoe portion 102 may be donned subsequently. Bottom end 158 of the calf portion 150 can then be slipped over the top end of shoe portion 102. Top end 154 of calf portion 150 can then be pulled up to its highest position without any further manipulation.

Figure 4F:
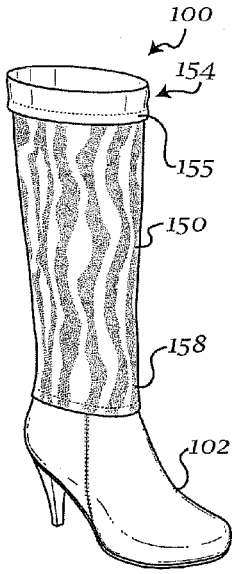

FIG. 4*f* shows an exemplary embodiment of boot 100 configured in a "reversible knee-high boot with a cuff" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position and inverted so as to form a fold, creating an upper cuff 155 which can reveal the outer material of calf portion 150.

Figure 4G:
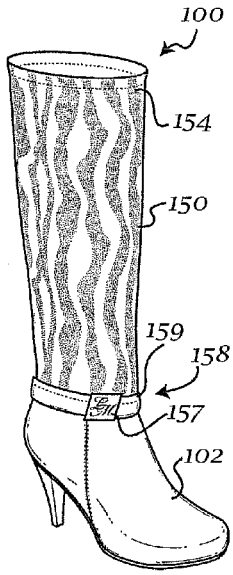

FIG. 4*g* shows an exemplary embodiment of boot 100 configured in a "reversible knee-high boot with ankle strap" style. Calf portion 150 may first be turned inside out and then donned, and shoe portion 102 may be donned subsequently. Bottom end 158 of \calf portion 150 can then be slipped over the top end of shoe portion 102. Top end 154 of calf portion 150 can then be pulled up to its highest position, while the bottom end 158 of calf portion 150 may be inverted so as to form a fold, creating a lower cuff 159 which can reveal the outer material of calf portion 150, thereby simulating an ankle strap. An ornament 157 may then be attached to the cuff so as to simulate a buckle.

Figure 4H:
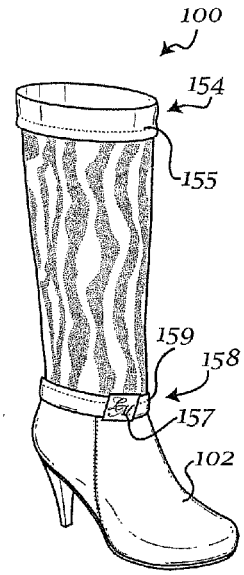

FIG. 4*h* shows an exemplary embodiment of boot 100 configured in a "reversible knee-high boot with cuff and ankle strap" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position, and both top end 154 and bottom end 158 may be inverted so as to form two folds, creating upper and lower cuffs 155, 159, which can reveal the outer material of calf portion 150. An ornament 157 may then be attached to the lower cuff so as to simulate a buckle.

Figure 5A:
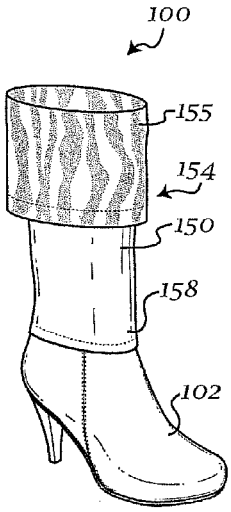
FIGS. 5*a*-5*d* show an exemplary embodiment of a two-piece transformable boot in a mid-calf boot with jumbo cuff configuration.

FIG. 5*a* shows an exemplary embodiment of boot 100 configured in a "mid-calf boot with jumbo cuff" style. Calf portion 150 may be donned first, followed by shoe portion 102. Bottom end 158 of calf portion 150 can then be slipped over the top end of shoe portion 102. Top end 154 of calf portion 150 can then be pulled up to its highest position. Top end 154 can then be inverted so as to form a fold and pulled downwards, reducing the height of boot 100 to a mid-calf height, and creating a large upper cuff 155 revealing the inner material of calf portion 150.

Figure 5B:
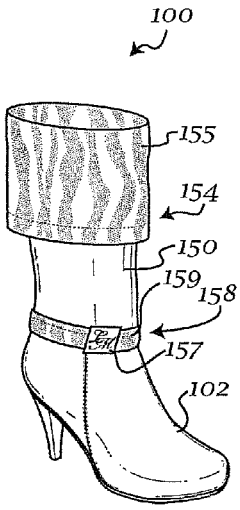

FIG. 5*b* shows an exemplary embodiment of boot 100 configured in a "mid-calf boot with jumbo cuff and ankle strap" style. Calf portion 150 may be donned first, followed by shoe portion 102. Bottom end 158 of calf portion 150 can then be slipped over the top end of shoe portion 102. Top end 154 of calf portion 150 can then be pulled up to its highest position. Top end 154 can then be inverted so as to form a fold and pulled downwards, reducing the height of boot 100 to a mid-calf height, and creating a large upper cuff 155 revealing the inner material of calf portion 150. Bottom end 158 can also be inverted so as to form a fold, creating a lower cuff 159 revealing the inner material of calf portion 150, thereby simulating an ankle strap. An ornament 157 may then be attached to the cuff so as to simulate a buckle.

Figure 5C:
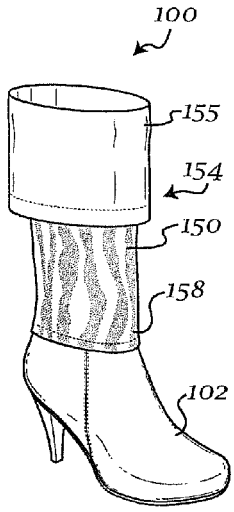

FIG. 5*c* shows an exemplary embodiment of boot 100 configured in a "reversible mid-calf boot with jumbo cuff" style. Calf portion 150 may first be turned inside out and then donned, and shoe portion 102 may be donned subsequently. Bottom end 158 of the calf portion 150 can then be slipped over the top end of shoe portion 102. Top end 154 of calf portion 150 can then be pulled up to its highest position. Top end 154 can then be inverted so as to form a fold and pulled downwards, reducing the height of boot 100 to a mid-calf height, and creating a large upper cuff 155 revealing the outer material of calf portion 150.

Figure 5D:
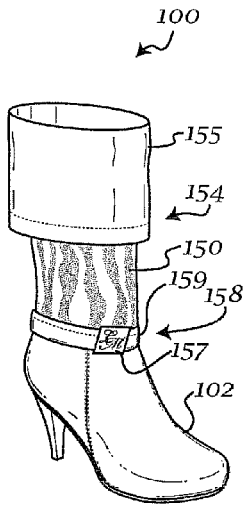

FIG. 5*d* shows an exemplary embodiment of boot 100 configured in a "reversible mid-calf boot with jumbo cuff and ankle strap" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position. Top end 154 can then be inverted so as to form a fold and pulled downwards, reducing the height of boot 100 to a mid-calf height, and creating a large upper cuff 155 revealing the outer material of calf portion 150. Bottom end 158 can also be inverted so as to form a fold, creating a lower cuff 159 revealing the outer material of calf portion 150, thereby simulating an ankle strap. An ornament 157 may then be attached to the cuff so as to simulate a buckle.

Figure 6A:
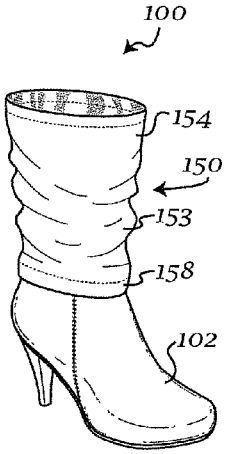
FIGS. 6*a*-6*h* show an exemplary embodiment of a two-piece transformable boot in a mid-calf slouch boot configuration.

FIG. 6*a* shows an exemplary embodiment of boot 100 configured in a "mid-calf slouch boot" style. Calf portion 150 may be donned first, followed by shoe portion 102. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height.

Figure 6B:
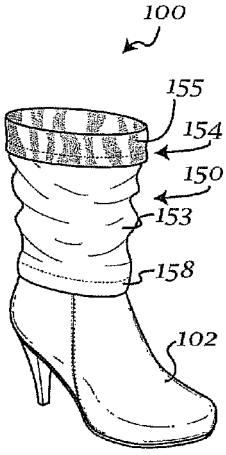

FIG. 6*b* shows an exemplary embodiment of boot 100 configured in a "mid-calf slouch boot with a cuff" style. Calf portion 150 may be donned first, followed by shoe portion 102. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height. Top end 154 of calf portion 150 can then be inverted so as to form a fold, creating an upper cuff 153 which can reveal the inner material of calf portion 150.

Figure 6C:
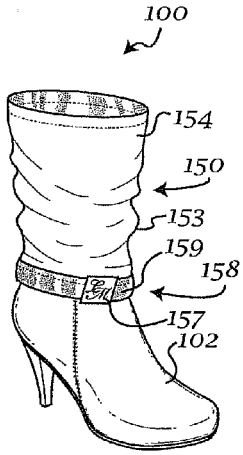

FIG. 6*c* shows an exemplary embodiment of boot 100 configured in a "mid-calf slouch boot with an ankle strap" style. Calf portion 150 may be donned first, followed by shoe portion 102. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height. Bottom end 158 of calf portion 150 may then be inverted so as to form a fold, creating a lower cuff 159 which can reveal the inner material of calf portion 150, thereby simulating an ankle strap. An ornament 157 may then be attached to the cuff so as to simulate a buckle.

Figure 6D:
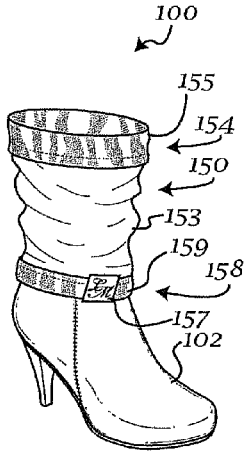

FIG. 6*d* shows an exemplary embodiment of boot 100 configured in a "mid-calf slouch boot with a cuff and ankle strap" style. Calf portion 150 may be donned first, followed by shoe portion 102. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 150 to a mid-calf height. Both the top end 154 and the bottom end 158 may then be inverted so as to form two folds, creating upper and lower cuffs 155, 159, which can reveal the inner material of calf portion 150. An ornament 157 may then be attached to the lower cuff so as to simulate a buckle.

Figure 6E:
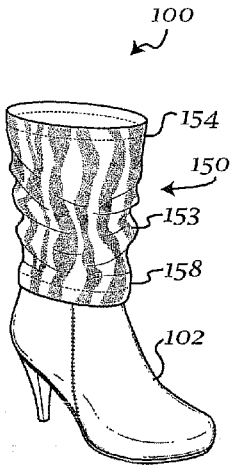

FIG. 6*e* shows an exemplary embodiment of boot 100 configured in a "reversible mid-calf slouch boot" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height.

Figure 6F:
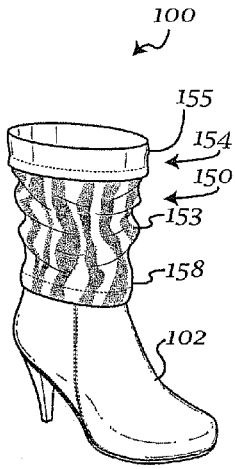

FIG. 6*f* shows an exemplary embodiment of boot 100 configured in a "reversible mid-calf slouch boot with a cuff" style. Calf portion 150 may first be turned inside out and then donned, and shoe portion 102 may be donned subsequently. Bottom end 158 of the calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height. Top end 154 of calf portion 150 can then be inverted so as to form a fold, creating an upper cuff 155 which can reveal the outer material of calf portion 150.

Figure 6G:
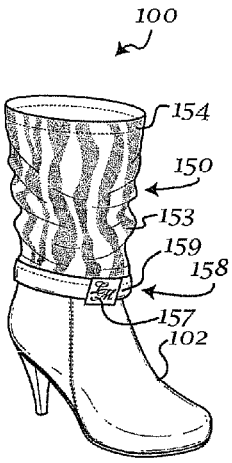

FIG. 6*g* shows an exemplary embodiment of boot 100 configured in a "reversible mid-calf slouch boot with an ankle strap" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height. Bottom end 158 of calf portion 150 may then be inverted so as to form a fold, creating a lower cuff 159 which can reveal the outer material of calf portion 150, thereby simulating an ankle strap. An ornament 157 may then be attached to the cuff so as to simulate a buckle.

Figure 6H:
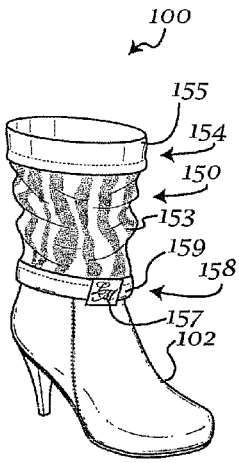

FIG. 6*h* shows an exemplary embodiment of boot 100 configured in a "reversible mid-calf slouch boot with a cuff and ankle strap" style. Calf portion 150 may first be turned inside out and then donned, and shoe portion 102 may be donned subsequently. Bottom end 158 of calf portion 150 can then be slipped over the top end of shoe portion 102. Top end 154 of calf portion 150 can then be pulled up to its highest position and subsequently pushed downwards, forming a plurality of folds or creases 153 in calf portion 150 and reducing the height of boot 100 to a mid-calf height. Both the top end 154 and the bottom end 158 may then be inverted so as to form two folds, creating upper and lower cuffs 155, 159, which can reveal the outer material of calf portion 150. An ornament 157 may then be attached to the lower cuff so as to simulate a buckle.

The configurations of exemplary embodiments of boot 100 shown in FIGS. 7*a*-7*d* may be achieved by first manipulating calf portion 150 into a "flared half-size" configuration. The flared half-size configuration may be achieved by inserting a first arm into top opening 156 of calf portion 150 and gripping bottom end 158 with the fingers of the first arm. The fingers of a second arm can then grip body 152 of tubular section 150 substantially at the midsection thereof. As the midsection of the tubular section is held in place, the first arm may be withdrawn from the calf portion while still gripping bottom end 158, thereby pulling bottom end 158 through the interior of calf portion 150 while forming a fold, and positioning bottom end 158 within top end 154. When top opening 152 and bottom opening 160 are aligned, any creases in the calf portion may be smoothed out and the flared half-size configuration can be achieved.

Figure 7A:
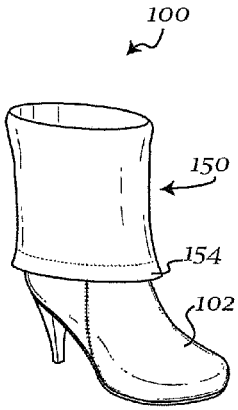
FIGS. 7*a*-7*d* show an exemplary embodiment of a two-piece transformable boot in a flared mid-calf boot configuration.

FIG. 7*a* shows an exemplary embodiment of boot 100 configured in a "flared mid-calf boot" style. Calf portion 150 may first be made flared half-size and then donned, and shoe portion 102 may be donned subsequently. Bottom end 158 of the calf portion 150 can then be slipped over the top end of shoe portion 102 without any further manipulation.

Figure 7B:
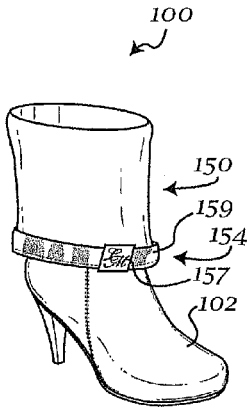

FIG. 7*b* shows an exemplary embodiment of boot 100 configured in a "flared mid-calf boot with ankle strap" style. Calf portion 150 may first be made flared half-size and then donned, and shoe portion 102 may be donned subsequently. Bottom end 158 of calf portion 150 can then be slipped over the top end of shoe portion 102. Top end 154, which is now disposed proximate bottom end 158, may then be inverted so as to form a fold, creating a lower cuff 159 which can reveal the inner material of calf portion 150, thereby simulating an ankle strap. An ornament 157 may then be attached to the cuff so as to simulate a buckle.

Figure 7C:
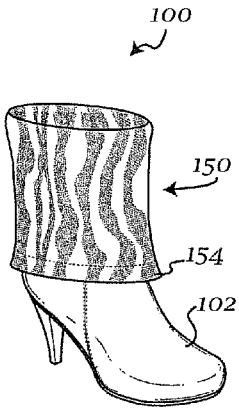

FIG. 7*c* shows an exemplary embodiment of boot 150 configured in a "reversible flared mid-calf boot" style. Calf portion 150 may first be turned inside out, then made flared half-size and then donned, and shoe portion 102 may be donned subsequently. Bottom end 158 of the calf portion 150 can then be slipped over the top end of shoe portion 102 without any further manipulation.

Figure 7D:
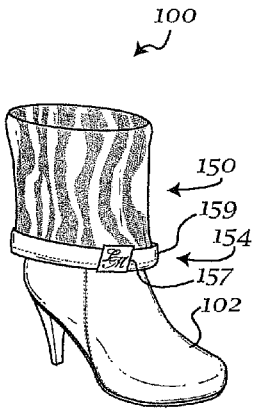

FIG. 7*d* shows an exemplary embodiment of boot 100 configured in a "reversible flared mid-calf boot with ankle strap" style. Calf portion 150 may first be turned inside out, then made flared half-size and then donned, and shoe portion 102 may be donned subsequently. Bottom end 158 of calf portion 150 can then be slipped over the top end of shoe portion 102. Top end 154, which is now disposed proximate bottom end 158, may then be inverted so as to form a fold, creating a lower cuff 159 which can reveal the outer material of calf portion 150, thereby simulating an ankle strap. An ornament 157 may then be attached to the cuff so as to simulate a buckle.

The configurations of exemplary embodiments of boot 100 shown in FIGS. 8*a*-8*d* may be achieved by first manipulating calf portion 150 into a "straight half-size" configuration. The straight half-size configuration may be achieved by inserting a first arm into bottom opening 160 of calf portion 150 and gripping top end 154 with the fingers of the first arm. The fingers of a second arm can then grip body 152 of tubular section 150 substantially at the midsection thereof. As the midsection of the tubular section is held in place, the first arm may be withdrawn from the calf portion while still gripping top end 154, thereby pulling the top end through the interior of calf portion 150 while forming a fold, and positioning top end 154 within bottom end 158. When top opening 156 and bottom opening 160 are aligned, any creases in the calf portion may be smoothed out and the straight half-size configuration can be achieved.

Figures 8A, 8B, 8C, 8D:
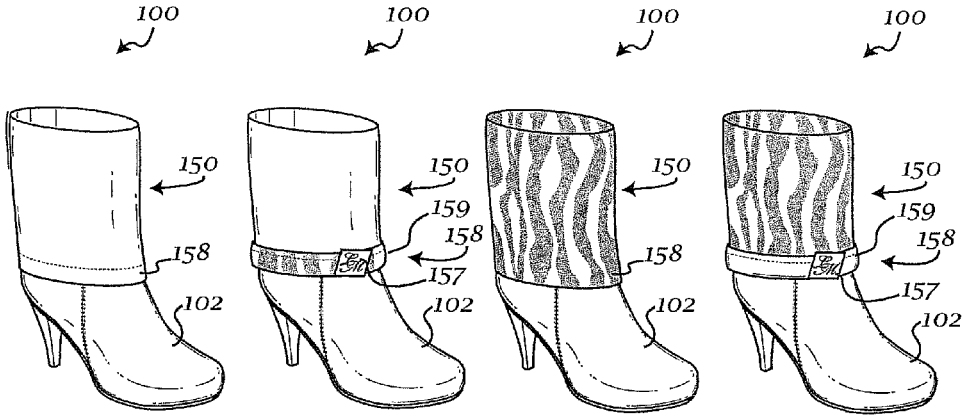
FIGS. 8*a*-8*d* show an exemplary embodiment of a two-piece transformable boot in a straight mid-calf boot configuration.

FIG. 8*a* shows an exemplary embodiment of boot 100 configured in a "straight mid-calf boot" style. Calf portion 150 may first be made straight half-size and then donned, and shoe portion 102 may be donned subsequently. Top end 154 of calf portion 150 can then be slipped over the top end of shoe portion 102 without any further manipulation.

FIG. 8*b* shows an exemplary embodiment of boot 100 configured in a "straight mid-calf boot with ankle strap" style. Calf portion 150 may first be made straight half-size and then donned, and shoe portion 102 may be donned subsequently. Top end 154 of calf portion 150 can then be slipped over the top end of shoe portion 102. Bottom end 158, which is now disposed proximate top end 154, may then be inverted so as to form a fold, creating a lower cuff 159 which can reveal the outer material of calf portion 150, thereby simulating an ankle strap. An ornament 157 may then be attached to the cuff so as to simulate a buckle.

FIG. 8*c* shows an exemplary embodiment of boot 100 configured in a "reversible straight mid-calf boot" style. Calf portion 150 may first be turned inside out, then made straight half-size and then donned, and shoe portion 102 may be donned subsequently. Top end 154 of calf portion 150 can then be slipped over the top end of shoe portion 102 without any further manipulation.

FIG. 8*d* shows an exemplary embodiment of boot 100 configured in a "reversible straight mid-calf boot with ankle strap" style. Calf portion 150 may first be turned inside out, then made straight half-size and then donned, and shoe portion 102 may be donned subsequently. Top end 154 of calf portion 150 can then be slipped over the top end of shoe portion 102. Bottom end 158, which is now disposed proximate top end 154, may then be inverted so as to form a fold, creating a lower cuff 159 which can reveal the inner material of calf portion 150, thereby simulating an ankle strap. An ornament 157 may then be attached to the cuff so as to simulate a buckle.

The configurations of exemplary embodiments of boot 100 shown in FIGS. 9*a*-9*h* may be achieved by donning calf portion 150 "upside-down," that is, donning the calf portion such that bottom end 158 is disposed between top end 154 and the wearer's knee, while top end 154 is disposed proximate the wearer's ankle. As the bottom opening is narrower than the top opening, the highest position of the bottom end in such configurations may typically be approximately at the mid-calf of the wearer. The wider top opening can then be pulled down such that calf portion 150 covers a greater part of shoe portion 102, creating a "covered heel" style, which can include a plurality of folds or creases therein.

Figures 9A, 9B, 9C, 9D:
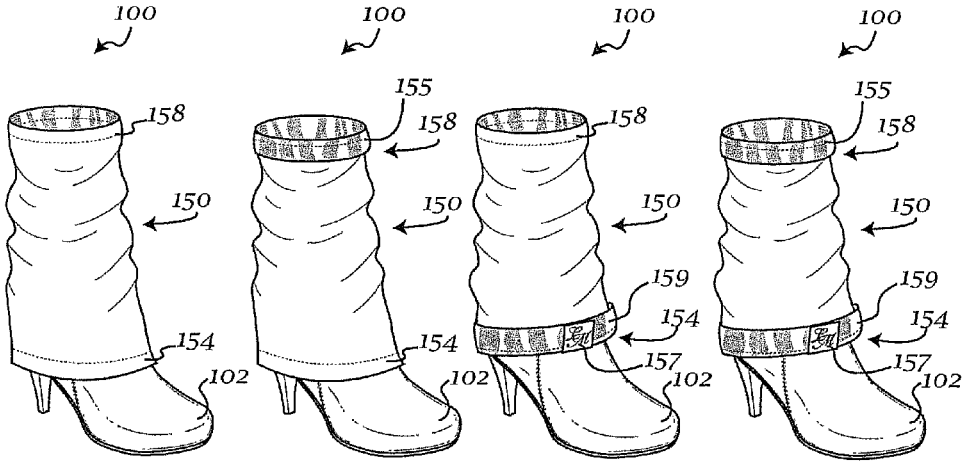
FIGS. 9*a*-9*h* show an exemplary embodiment of a two-piece transformable boot in a covered heel boot configuration.

FIG. 9*a* shows an exemplary embodiment of boot 100 configured in a "covered heel boot" style. Calf portion 150 may be donned upside down, followed by shoe portion 102. Top end 154 of the calf portion 150 can then be slipped over the top end of shoe portion 102. Bottom end 158 of calf portion 150 can then be pulled up to its highest position without any further manipulation.

FIG. 9*b* shows an exemplary embodiment of boot 100 configured in a "covered heel boot with a cuff" style. Calf portion 150 may be donned upside down, followed by shoe portion 102. Top end 154 of calf portion 150 can then be slipped over the top end of shoe portion 102. Bottom end 158 of calf portion 150 can then be pulled up to its highest position and inverted so as to form a fold, creating an upper cuff 155 which can reveal the inner material of calf portion 150.

FIG. 9*c* shows an exemplary embodiment of boot 100 configured in a "covered heel boot with an ankle strap" style. Calf portion 150 may be donned upside down, followed by shoe portion 102. Top end 154 of calf portion 150 can then be slipped over the top end of shoe portion 102. Bottom end 158 of calf portion 150 can then be pulled up to its highest position, while top end 154 can then be inverted so as to form a fold, creating a lower cuff 159 which can reveal the inner material of calf portion 150, thereby simulating an anlde strap. An ornament 157 may then be attached to the cuff so as to simulate a buckle.

FIG. 9*d* shows an exemplary embodiment of boot 100 configured in a "covered heel boot with cuff and ankle strap" style. Calf portion 150 may be donned upside down, followed by shoe portion 102. Top end 154 of calf portion 150 can then be slipped over the top end of shoe portion 102. Bottom end 158 of calf portion 150 can then be pulled up to its highest position, and both bottom end 158 and top end 154 may be inverted so as to form two folds, creating upper and lower cuffs 155, 159 which can reveal the inner material of calf portion 150. An ornament 157 may then be attached to the cuff so as to simulate a buckle.

Figures 9E, 9F, 9G, 9H:
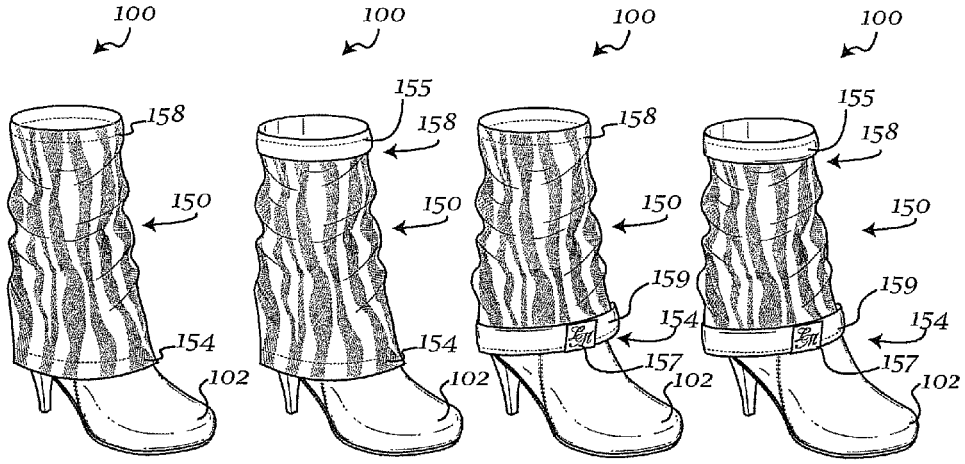

FIG. 9*e* shows an exemplary embodiment of boot 100 configured in a "reversible covered heel boot" style. Calf portion 150 may first be turned inside out and then donned upside down, and shoe portion 102 may be donned subsequently. Top end 154 of the calf portion 150 can then be slipped over the top end of shoe portion 102. Bottom end 158 of calf portion 150 can then be pulled up to its highest position without any further manipulation.

FIG. 9*f* shows an exemplary embodiment of boot 100 configured in a "reversible covered heel boot with a cuff" style. Calf portion 150 may first be Top end 154 of calf portion 150 can then be slipped over the top end of shoe portion 102. Bottom end 158 of calf portion 150 can then be pulled up to its highest position and inverted so as to form a fold, creating an upper cuff 155 which can reveal the outer material of calf portion 150.

FIG. 9*g* shows an exemplary embodiment of boot 100 configured in a "reversible covered heel boot with an ankle strap" style. Calf portion 150 may first be turned inside out and then donned upside down, and shoe portion 102 may be donned subsequently. Top end 154 of calf portion 150 can then be slipped over the top end of shoe portion 102. Bottom end 158 of calf portion 150 can then be pulled up to its highest position, while top end 154 can then be inverted so as to form a fold, creating a lower cuff 159 which can reveal the outer material of calf portion 150, thereby simulating an ankle strap. An ornament 157 may then be attached to the cuff so as to simulate a buckle.

FIG. 9*h* shows an exemplary embodiment of boot 100 configured in a "covered heel boot with cuff and ankle strap" style. Calf portion 150 may first be turned inside out and then donned upside down, and shoe portion 102 may be donned subsequently. Top end 154 of calf portion 150 can then be slipped over the top end of shoe portion 102. Bottom end 158 of calf portion 150 can then be pulled up to its highest position, and both bottom end 158 and top end 154 may be inverted so as to form two folds, creating upper and lower cuffs 155, 159 which can reveal the outer material of calf portion 150. An ornament 157 may then be attached to the cuff so as to simulate a buckle.

Figures 10A, 10B:
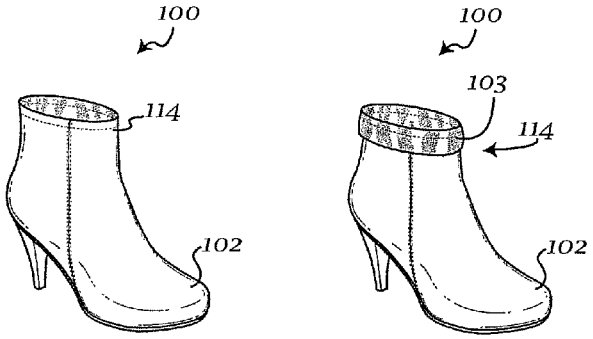
FIGS. 10*a*-10*b* show an exemplary embodiment of a two-piece transformable boot in an ankle boot configuration.

FIGS. 10*a*-10*b* show an exemplary embodiment of boot 100 wherein shoe portion 102 is worn without calf portion 150. Shoe portion 102 may include a lining 103 which may have one end sewn to the inside of the top end of the shoe portion, and a free end. The free end may be pulled out from the shoe portion such that lining 1030 is disposed over a portion of the top end 114 of shoe portion 102.

FIG. 10*a* shows an exemplary embodiment of boot 100 in an "ankle boot" style, wherein shoe portion 102 is donned without any further manipulation.

FIG. 10*b* shows an exemplary embodiment of boot 100 configured in an "ankle boot with a cuff" style, wherein lining 103 of the shoe portion is pulled out and placed over the top end 114 of shoe portion 102, after which shoe portion 102 may be donned.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is clamed is:

1. A two-piece convertible boot, comprising:

a shoe portion for enclosing a wearer's foot and extending substantially up to the wearer's ankle, the shoe portion comprising a sole, an insole, a heel and an upper;

the shoe portion further comprising an opening for inserting the wearer's foot, and a top end extending downward from the opening; and a calf portion for enclosing a portion of the wearer's calf;

the calf portion comprising a top opening disposed at a top end of the calf portion, and a bottom opening disposed at a bottom end of the calf portion, the bottom end of the calf portion extending upward from the bottom opening;

a flap comprising a fixed portion fixedly coupled to the shoe portion, and a movable portion selectively positionable between a first position proximate a portion of the top end of the shoe portion and a second position away from the top end of the shoe portion;

a magnet disposed within the movable portion of the flap; and a complementary magnet disposed within the top end of the shoe portion; the magnet and the complementary magnet being positioned such that when the movable portion is proximate the top end of the shoe portion, the magnets attract each other so as to couple the movable portion of the flap to the top end of the shoe portion; and wherein the bottom end of the calf portion is adapted to overlap the top end of the shoe portion so as to form a friction fit between the bottom end of the calf portion and the top end of the shoe portion; and wherein a part of the bottom end of the calf portion is disposable between the top end of the shoe portion and the movable portion of the flap.

2. The two-piece convertible boot of claim 1, wherein:

the top end of the shoe portion has an outer circumference;

the bottom end of the calf portion has an inner circumference;

the inner circumference is substantially similar to the outer circumference along the overlap between the top end of the shoe portion and the bottom end of the calf portion.

3. The two-piece convertible boot of claim 2, wherein the length of the overlap between the top end of the shoe portion and the bottom end of the calf portion is sufficient to prevent separation of the calf portion from the shoe portion when the boot is in use.

4. The two-piece convertible boot of claim 1, wherein the friction fit prevents separation of the calf portion from the shoe portion without the use of zipper couplings between the two portions.

5. The two-piece convertible boot of claim 1, wherein the calf portion further comprises:

an inner surface; and an outer surface;

the inner surface and the outer surface having a dissimilar appearance, material, or texture.

6. The two-piece convertible boot of claim 5, wherein the calf portion is reversible.

7. The two-piece convertible boot of claim 1, wherein the calf portion is adapted to be manipulated into a plurality of configurations.

8. The two-piece convertible boot of claim 7, further comprising:

a plastically deformable structure disposed within the calf portion;

wherein the plastically deformable structure is adapted to maintain a configuration of the calf portion while the boot is in use.

9. The two-piece convertible boot of claim 7, wherein any configuration of the plurality of configurations comprises at least one fold or crease formed in the calf portion.

10. The two-piece convertible boot of claim 7, wherein the plurality of configurations comprises one or more of: a knee-high boot, a mid-calf boot, a mid-calf slouch boot, a flared mid-calf boot, a straight mid-calf boot, and a covered heel boot.

11. The two-piece convertible boot of claim 7, wherein any configuration of the plurality of configurations comprises one or more of an upper cuff and a lower cuff.

12. The two-piece convertible boot of claim 1, further comprising an ornament selectively couplable to the calf portion.

13. A two-piece convertible boot, comprising:

a shoe portion for enclosing a wearer's foot and extending substantially up to the wearer's ankle, the shoe portion comprising a sole, an insole, a heel and an upper;

the shoe portion further comprising an opening for inserting the wearer's foot, a top end extending downward from the opening, and a fastener disposed on or proximate the top end; 'and a calf portion for enclosing a portion of the wearer's calf;

the calf portion comprising a top opening disposed at a top end of the calf portion and a bottom opening disposed at a bottom end of the calf portion, the bottom end of the calf portion extending upward from the bottom opening;

wherein the bottom end of the calf portion is adapted to overlap a portion of top end of the shoe portion; and wherein the fastener is not a zipper;

wherein when the bottom end of the calf portion overlaps the top end of the shoe portion, a part of the bottom end of the calf portion is disposed between the top end of the shoe portion and a portion of the fastener; and the fastener exerts a force on the bottom end of the calf portion so as to prevent separation of the calf portion from the shoe portion when the boot is in use;

wherein the fastener is a flap comprising a fixed portion fixedly coupled to the shoe portion, and a movable portion selectively positionable between a first position proximate a portion of the top end of the shoe portion and a second position away from the top end of the shoe portion; and wherein the fastener further comprises a magnet; and the top end of the shoe portion further comprises a complementary magnet positioned to attract the magnet of the fastener.

14. The two-piece convertible boot of claim 13, wherein:

the calf portion is adapted to be manipulated into a plurality of configurations and to maintain a configuration when the boot is in use.

* * * * *